United States Patent [19]

Bietz

[11] Patent Number: 4,863,055

[45] Date of Patent: Sep. 5, 1989

[54] BAFFLE ARRANGEMENT FOR LIQUID-TRANSPORT VESSELS

[76] Inventor: Harvey Bietz, 1333-16 Street, N.W., Calgary, Alberta, Canada, T2N 2C7

[21] Appl. No.: 199,802

[22] Filed: May 27, 1988

[51] Int. Cl.[4] ..... B65D 1/24

[52] U.S. Cl. ..... 220/5 A; 280/837; 105/360

[58] Field of Search ..... 220/1 B, 5 A, 20.5, 220/85 S; 280/5 C, 5 D, 5 E; 105/360

[56] References Cited

U.S. PATENT DOCUMENTS

| | | | |
|---|---|---|---|
| 3,995,541 | 12/1976 | Coyle et al. | 105/360 X |
| 4,251,005 | 2/1981 | Sons et al. | 280/5 C X |
| 4,483,454 | 11/1984 | Rogers et al. | 220/5 A |
| 4,610,376 | 9/1986 | Regent | 220/5 A X |
| 4,796,773 | 1/1989 | Gerhard | 220/85 S X |

FOREIGN PATENT DOCUMENTS

| | | |
|---|---|---|
| 778146 | 2/1968 | Canada . |
| 834487 | 2/1970 | Canada . |
| 937881 | 12/1973 | Canada . |

*Primary Examiner*—John Fox

*Attorney, Agent, or Firm*—Jones, Tullar & Cooper

[57] ABSTRACT

A baffle arrangement for pressurized or non-pressurized liquid cargo transport vessels includes a plurality of baffle members supported within the vessel at or slightly below the upper level of the liquid within the vessel to reduce sloshing of the liquid during vessel movement. Individual baffle members are supported at their ends by transverse support members which in turn are secured to brackets welded to the inner walls of the vessel. The baffle arrangement separates the vessel into a lower liquid carrying chamber and an upper substantially empty chamber. By reducing the sloshing effect the stability of the vehicle carrying the vessel will be increased substantially.

14 Claims, 4 Drawing Sheets

BAFFLE ARRANGEMENT FOR LIQUID-TRANSPORT VESSELS

The present invention relates to liquid cargo transport vessels in general and to a baffle arrangement for the vessel's interior in particular.

BACKGROUND OF THE INVENTION

Liquid cargoes are typically transported by rail or highway in specially designed rail cars, trucks or trailers which include a containment vessel as a major component thereof. Certain cargoes, such as water or milk are transported with the interior of the vessel at atmospheric pressure while other cargoes, such as LPG's (Liquid Petroleum Gases) are transported with the interior of the vessel under pressure. Usually the transport vessel will be in the shape of an elongated cylinder, carried by a suitable frame and running gear arrangement.

Currently, liquids are allowed to move freely within transport vessels with the result that the vessels cannot be loaded to 100% capacity, due to the physical properties of the products being transported and due to weight or load restrictions placed on transportation vehicles. It is also recognized that expansion due to temperature rises must be accommodated within the vessel. For example, when shipping propane it is necessary to provide 15% of the vessel's volume for fluctuations due to temperature increases, meaning that the vessel can be filled only to a level corresponding to 85% of the vessel's volume. Accordingly, most liquids will move within the vessel as it moves, creating a "sloshing" effect that can produce detrimental results.

Forward, backward and sideways movement of the liquid product during stopping, starting and changing directions can cause accidents, such as vehicle roll-over, and can reduce the driver's ability to stop the vehicle, or change directions, in a smooth predictable manner. It has been reported in the Province of Alberta, for example, that 7 out of 8 roll-overs were largely due to product movement.

In recent years, the diameter of all liquid transportation vessels has been increased in order to accommodate increased permissible gross vehicle weights and upgraded vehicle configurations. For example, the average diameter of propane transportation vessels for road use has gone from 84 inches (213 cm) to 102 inches (259 cm), meaning a raising of the center of gravity of the vessel. This, in combination with the movement of the liquid creates a compound negative effect on the performance of the vessel.

There have been attempts to compensate for product movement, including the provision of transverse baffles or walls. For example, Canadian Patent No. 937,881 of Dec. 4, 1973 illustrates a fuel tank for a vehicle including a telescoping baffle which expands to fill an increasing volume of the tank as the fuel is removed therefrom. While this patent recognizes some benefit to reducing the sloshing effect the invention of the patent would not be practical on the large scale required for transport vessels. Canadian Patent No. 834,687 of Apr. 21, 1970 shows a rail car with a horizontal wall 27,27' therein but there are no anti-sloshing features attributable to the structure disclosed therein.

SUMMARY OF THE INVENTION

The present invention is directed at reducing substantially the sloshing effects as liquid is transported in vessels, whether the liquid be under pressure or not. This reduction is achieved by providing a baffle arrangement within the vessel, the arrangement including a plurality of baffle members carried by transverse support members which in turn are carried by bracket means secured to the inside wall of the vessel. Preferably, the baffle members separate the vessel into a lower liquid (cargo) carrying chamber and an upper, substantially empty, chamber. The baffle members are preferably positioned at or just slightly below the maximum level to which the liquid will be introduced into the lower chamber.

If the vessel is to be retrofitted with the baffle arrangement of the present invention then the baffle members will be relatively narrow so as to fit into the vessel via the access opening therein. A plurality of baffle members can be bolted edge to edge to the transverse support members which in turn are bolted to brackets or plates welded to the inner walls of the vessel at the appropriate level. The brackets and support members will be spaced apart along the length of the vessel with the bracket members extending between pairs of the support members.

It is not necessary to seal the edges of the baffle members since a small amount of leakage from the lower chamber to the upper chamber is desirable for pressure equalization. The baffle members may also be provided with one or more drainage holes if desired.

If a transport vessel is expected to carry more than one type of cargo then brackets may be provided at different levels within the vessel so that baffles can be arranged at the appropriate level. For example, if the vessel is to transport both propane and butane provisions can be made to arrange the baffles for propane at a level such that the volume of the lower chamber is about 85% of the vessel volume, and for butane at a level such that the volume of the lower chamber is 65% of the vessel volume. Alternatively the baffles can be arranged to slope downwardly both forwardly and rearwardly from an intermediate high point which, for propane, can be at the 85% level. If the other commodity to be carried is butane then the low point of the baffles will correspond to about the 65% level.

By using a baffle arrangement in accordance with this invention, there will be a minimum of sloshing of the liquid cargo and hence the detrimental effects associated with such sloshing will be greatly reduced, resulting in safer, more stable, transport of liquid cargoes.

DESCRIPTION OF THE PREFERRED EMBODIMENT

The baffle arrangement of the present invention is intended for use with liquid cargo transport vessels including railway tank cars, and tank trucks and trailers as might travel the highways. The vessels could carry pressurized or non-pressurized liquid cargo and more than one type of liquid could be carried in the vessel. Typical cargoes that might be carried include water, acids, LPG's (Liquid Petroleum Gases), anhydrous ammonia, olive oil, liquors, milk, ink, sewage, refined petroleum products, liquid oxygen, methanol, chemicals, and liquid food products. Of course many other types of liquids are routinely transported by such vessels and the present invention is equally effective therewith.

Figure 1:
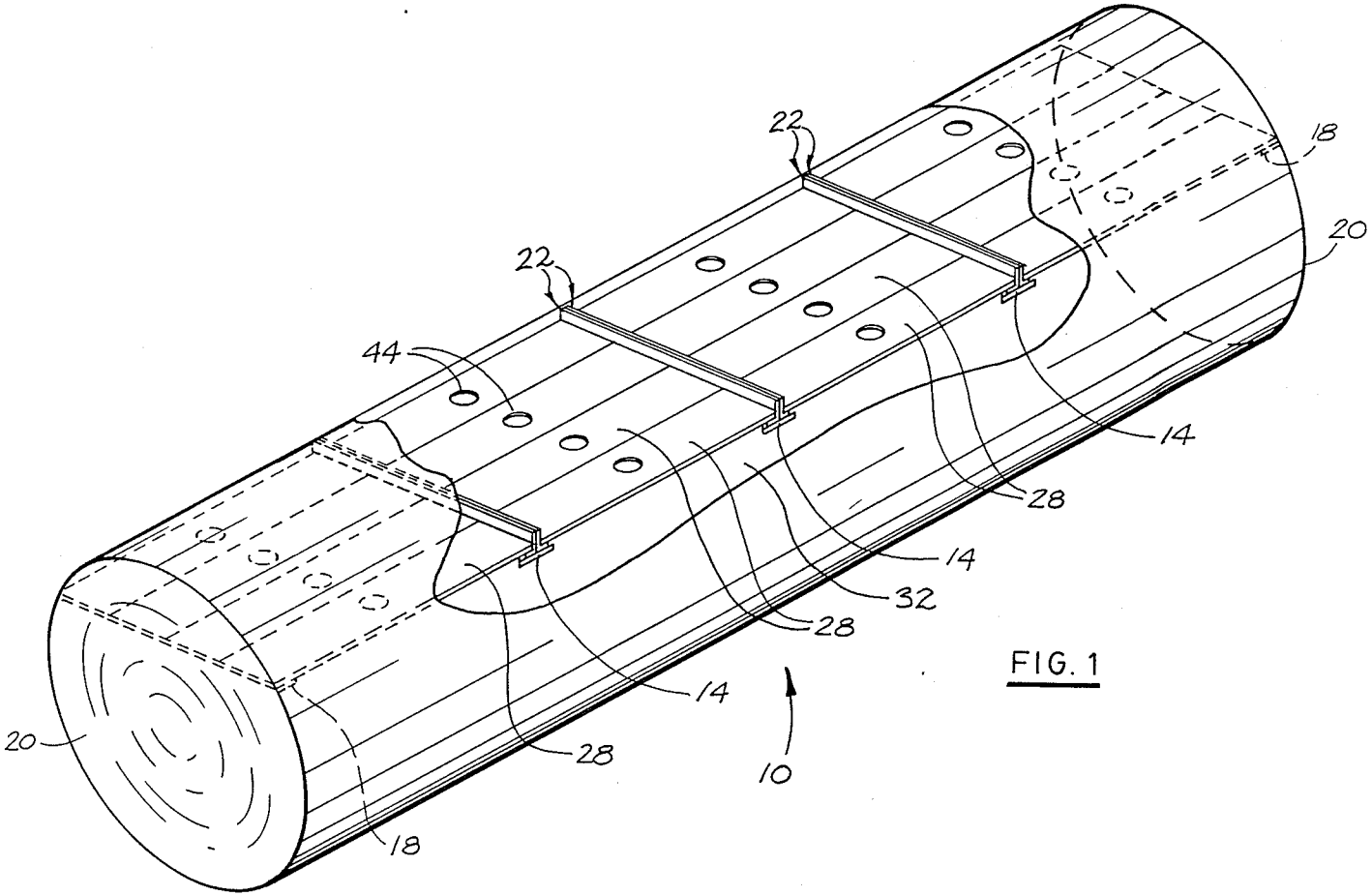
FIG. 1 is a perspective view of a transport vessel, partially cut away, showing a baffle arrangement of the present invention therein.

In FIG. 1 reference number 10 is used to identify a typical transport vessel, shown for the sake of simplicity as a cylindrical tank. The design and configuration of the vessel 10 is not particularly significant except that the baffle arrangement will have to fit the specific vessel for which it is intended. Also for the sake of simplicity, the means by which the vessel 10 is transported has not been shown.

Figure 2:
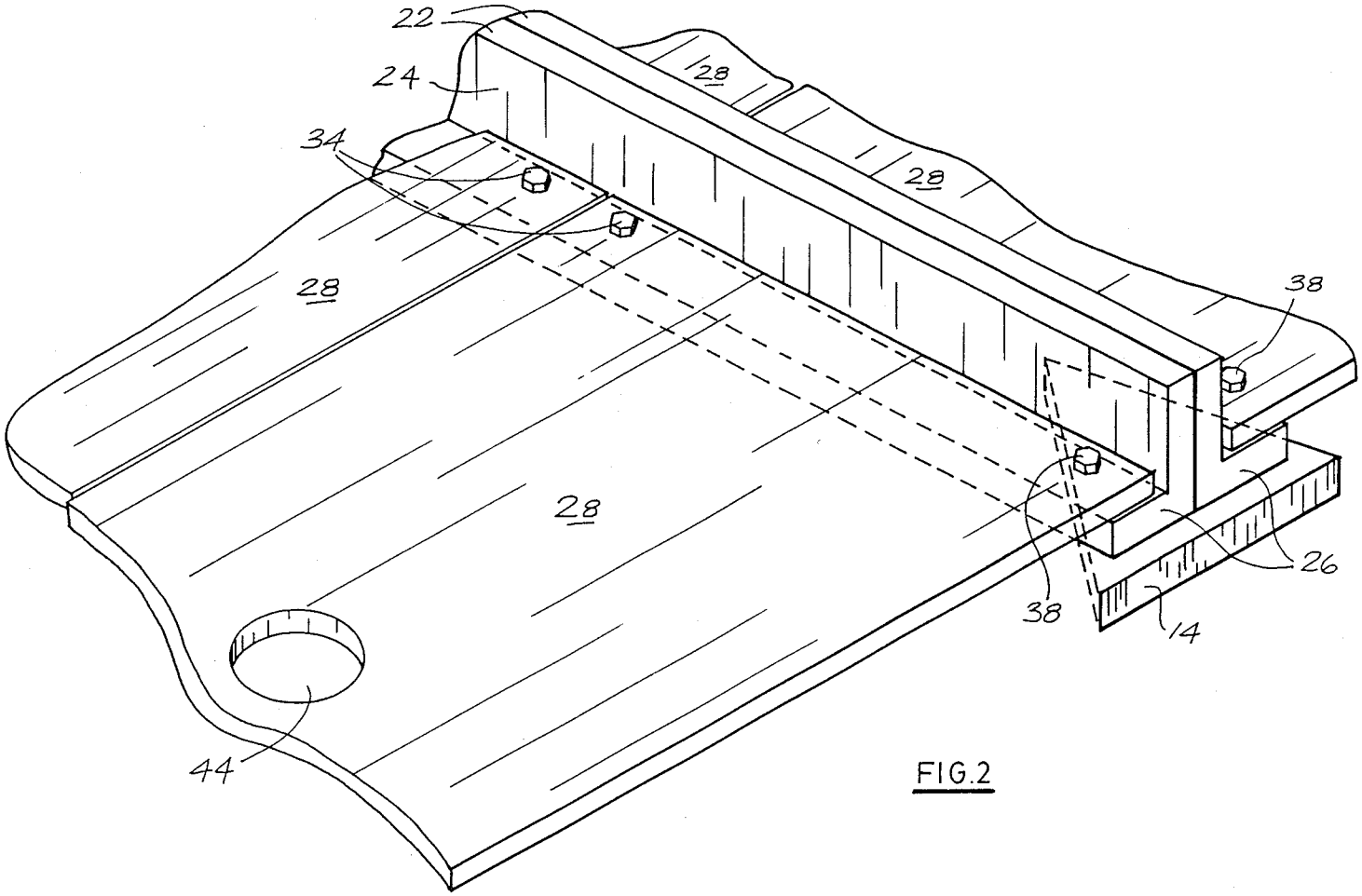
FIG. 2 is a perspective view showing the assembly and support details.
Figure 3:
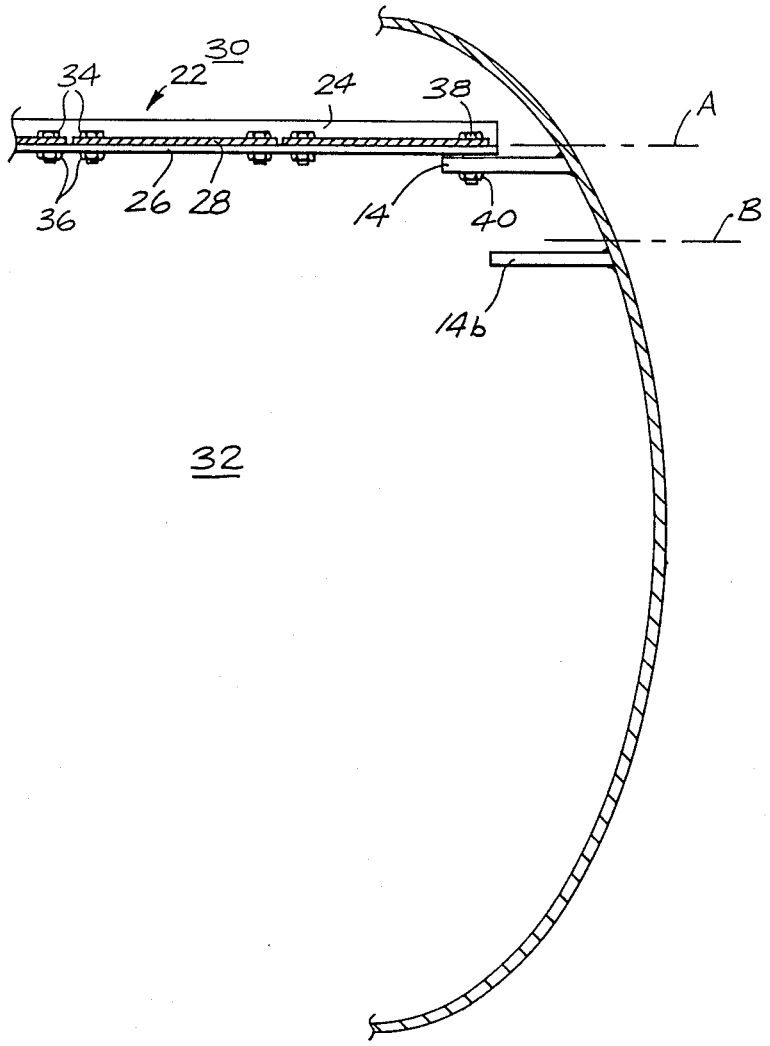
FIG. 3 is a partial cross-section of a transport vessel, showing the baffle arrangement therein.

With reference to FIGS. 1, 2 and 3, the baffle arrangement 12 of the present invention will now be described. The arrangement includes first of all a plurality of bracket means, in the form of triangular plates 14, welded or otherwise secured to the interior wall surface 16 of the vessel 10, the plates 14 being spaced apart along the length of the vessel and projecting into the interior thereof (FIG. 3). The plates 14 along one wall 16 will be opposite the plates on the other wall 16 of the vessel. Slightly smaller (e.g. right triangular plates) 18 will be provided at each end, welded to the side wall surface 16 and to the interior wall surface of the vessels end walls 20.

At each of the intermediate bracket plates 14 a pair of back-to-back support members, in the form of angle-iron members 22, extend transversely of the vessel with the respective ends of the members 22 being supported by corresponding plates 14. Each member 22 includes an upright leg 24 and a horizontal leg 26, the upright legs 24 being adjacent each other and the horizontal legs 26 resting on the plates 14. A single member 22 can be provided at each end to span the distance between the end plates 18.

Extending between pairs of support members 22 is a plurality of elongated, generally rectangular baffle members 8, there being a sufficient number of baffle members 28 to effectively separate the interior of the vessel into an upper chamber 30 and a lower cargo carrying chamber 32. Each member 28 rests at its ends on an appropriate horizontal leg 26 of the adjacent support member 22 and is preferably secured thereto by bolts 34 which pass through aligned holes (not shown) in the member 28 and the subjacent leg 26 and receive nuts 36 which, when tightened on the bolts 34 will clamp the members 28 to the support members 22. At each end of the support member a bolt 38 passes through aligned holes (not shown) in the baffle member 28, leg 26 and bracket plate 14 and a nut 40 is threaded thereon and tightened to clamp the baffle assembly to the plate 14.

Figure 5:
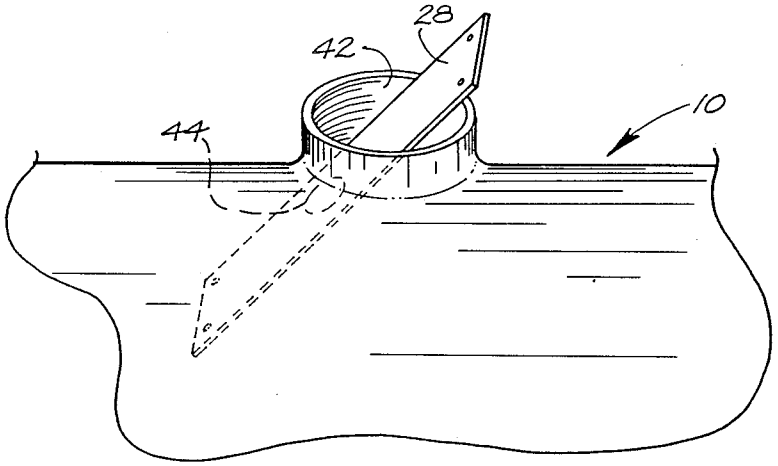
FIG. 5 illustrates the introduction of a baffle member into a transport vessel.

FIG. 5 illustrates that a narrow baffle member 28 can be introduced into a vessel via the usual access port 42, typically having a diameter of about 18 inches (46 cm). Thus it is possible to use a plurality of plate members 28 having a width slightly less than the access port diameter and preferably a whole fraction of the width of the vessel where it is spanned by the baffle members 28. Each baffle member 28 typically may have a length of about 8 feet (244 cm), depending of course on the length of the vessel's interior. When the baffle members are assembled to the support members within the vessel their edges will abut each other, the adjacent vertical leg 24 as appropriate and possibly the interior wall surface of the vessel. However it is not necessary to seal the edges as a certain amount of drainage is desirable past such edges. Further drainage can be obtained with a 2 inch (5 cm) drainage hole 44 in the central portion of each member 28.

Preferably the baffle members 28 will be positioned within the vessel at a level A which is at or just slightly below the level of the fluid to be carried by the vessel. Typically the level A may be such that the volume of chamber 32 is about 85% of the total volume of the vessel (for carrying propane). As shown in FIG. 3, additional bracket plates **14*b* may be provided at other levels within the vessel if the vessel is to carry different commodities. For example, the bracket plates 14*b* could be positioned so that when the support members 22 are bolted thereto and the baffle members 28 are supported thereon the baffle members will be at a level B such that about 65% of the vessel's volume is therebelow in chamber 32 (for carrying butane). Bracket plates 14** can be positioned at any level within the vessel, depending on the product to be transported.

Figure 4:
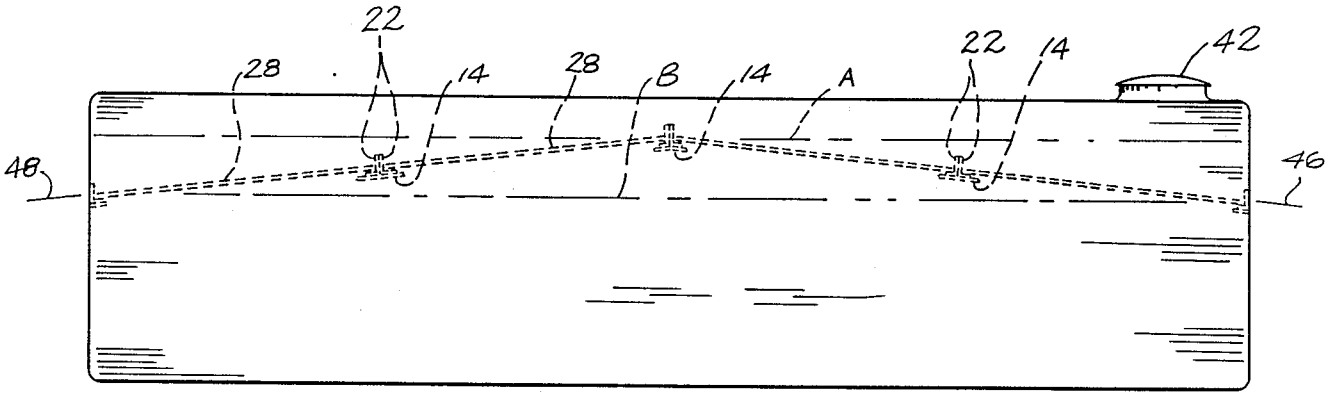
FIG. 4 is an elevational view showing an alternative baffle arrangement.

FIG. 4 illustrates an alternative embodiment wherein baffle members 28 are carried by support members 22 and bracket plates 14 so that the baffle members 28 slope downwardly, forwardly and rearwardly along lines 46, 48 respectively from a high point at level A intermediate the length of the vessel to low points at level B at the ends of the vessel. Levels A and B can be the same 85% and 65% volume levels as described hereinabove. This configuration would be used in vessels which would be assigned two different commodities by differing densities. For example, propane and butane would involve the same design characteristics as previously described with the exception of the sloping baffle configuration. The propane level would be at the high point or 85% level while the low points would be at the butane or 65% level. This arrangement would result in a minimization of cargo movement in forward, backward or sideways directions for both types of liquids, adding flexibility to the vessel's applications.

In summary therefore, by providing a baffle arrangement according to this invention within a liquid cargo transport vessel it is possible to significantly reduce the sloshing movement of the liquid during travel of the vessel. This greatly reduces shifts in the center of gravity of the cargo and reduces the possibility of vessel rollover or swaying movement, especially for trailers. The mechanical wear and tear on the running gear is also reduced and with road vehicles especially increased stability will lessen driver fatigue.

While preferred forms of the present invention have been described herein it is understood that refinements or changes therein could be effected without departing from the spirit of the invention. Thus the protection to be afforded the invention is to be determined from the claims appended hereto.

The embodiments of the invention in which an exclusive property or privilege is claimed are defined as follows:

1. A baffle arrangement for use in an elongated hollow liquid-cargo transport vessel comprising:

a plurality of longitudinally spaced apart bracket means located on opposite interior wall surfaces of said vessel;

a plurality of longitudinal spaced apart support members each extending transversely of said vessel and being supported at each end thereof by a corresponding one of said bracket means; and a plurality of transversely adjacent, elongated, generally rectangular baffle members extending longitudinally between spaced apart pairs of said support members to effectively separate said vessel into a lower cargo-carrying chamber and an upper chamber.

2. The arrangement of claim 1 wherein said baffle members are each provided with at least one aperture therethrough, through which liquid cargo carried by said vessel may pass.

3. The arrangement of claim 2 wherein said baffle members are positioned at a level within said vessel corresponding to at least the level of liquid cargo to be carried by said vessel.

4. The arrangement of claim 2 wherein said baffle members are positioned at a level within said vessel which is slightly below the level of liquid cargo to be carried by said vessel.

5. The arrangement of claim 2 wherein a first set of bracket means is provided so as to selectively locate said baffle members at a first level whereby said lower chamber comprises about 85% of the volume of the vessel, and a second set of bracket means is provided so as to selectively locate said baffle members at a second level whereby said lower chamber comprises about 65% of the volume of the vessel.

6. The arrangement of claim 2 wherein said bracket means are secured to the walls of said vessel so as to locate said baffle members along downward sloping lines extending forwardly and rearwardly from a high point intermediate the length of the vessel.

7. The arrangement of claim 6 wherein said high point is at a first level such that about 85% of the volume of the vessel is therebelow and the lowest point of said baffle members is at a second level such that about 65% of the volume of said vessel is therebelow.

8. The arrangement of claim 2 wherein said bracket means includes a plurality of generally horizontal triangular plates welded to the interior walls of said vessel and projecting inwardly of said vessel, said plates being spaced apart along said walls so that each may support the ends of corresponding support members thereon.

9. The arrangement of claim 8 wherein each of said baffle members comprises a section of sheet steel sized to extend between a pair of spaced apart support members, each baffle member having a width which is a whole fraction of the width of said baffle arrangement and which will permit introduction of the baffle member into the vessel through an access opening thereof.

10. The arrangement of claim 9 wherein each of said support members is a suitable length of angle iron and is provided with a through hole at each end thereof for bolting to opposed ones of said triangular plates, said support members having additional holes along the length thereof such that the baffle members may be bolted thereto.

11. A baffle arrangement for use in an elongated, generally cylindrical, hollow liquidcargo transport vessel comprising: a plurality of longitudinally spaced apart bracket plates welded to opposite interior wall surfaces of said vessel at a predetermined level therein; a plurality of longitudinally spaced apart support members extending transversely of said vessel, supported by and secured to corresponding opposed ones of said bracket plates; and a plurality of apertured, transversely adjacent, generally rectangular elongated baffle members extending between spaced apart pairs of said support members to create a transverse generally horizontal baffle wall separating said vessel into a lower cargo-carrying chamber and an upper chamber.

12. The arrangement of claim 11 wherein said bracket plates are positioned so as to locate said baffle members at a level within said vessel which is at or slightly below the level of liquid cargo to be carried by said vessel.

13. The arrangement of claim 11 wherein a first set of said bracket plates is positioned so as to selectively locate the baffle members at a first level whereby said lower chamber comprises about 85% of the volume of the vessel, and a second set of bracket plates is positioned so as to selectively locate the baffle members at a second level whereby the lower chamber comprises about 65% of the volume of the vessel.

14. A baffle arrangement for use in an elongated, generally cylindrical, hollow liquid-cargo transport vessel comprising:

a plurality of longitudinally spaced apart bracket plates located on opposite interior wall surfaces of said vessel along lines sloping downwardly, forwardly and rearwardly, from a high point intermediate the length of the vessel to low points adjacent the respective ends of the vessel;

a plurality of longitudinally spaced apart support members extending transversely of said vessel and supported at each end thereof by corresponding ones of said bracket plates; and a plurality of apertured, elongated, baffle members extending between spaced apart pairs of said support members to effectively separate said vessel into a lower cargo-carrying chamber and an upper chamber, said high point being at a first level such that about 85% of the volume of the vessel is therebelow and said low points being at a second level such that about 65% of the volume of the vessel is therebelow.

* * * * *